US006027211A

United States Patent [19]

Unosawa et al.

[11] Patent Number: 6,027,211

[45] **Date of Patent: *Feb. 22, 2000**

[54] SHEET FEEDING APPARATUS AND RECORDING APPARATUS

[75] Inventors: Yasuhiro Unosawa, Tokyo; Hiroyuki Saito, Yokohama; Koichi Tanno, Kawasaki; Haruyuki Yanagi, Machida; Makoto Kawarama, Kawasaki; Hiroyuki Kinoshita, Kawasaki; Masaya Shinmachi, Kawasaki; Tan At Ming, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/683,649

[22] Filed: Jul. 15, 1996

[30] Foreign Application Priority Data

Jul. 14, 1995 [JP] Japan ..... 7-178399
Aug. 11, 1995 [JP] Japan ..... 7-205547

[51] Int. Cl.[7] ..... B41J 2/01

[52] U.S. Cl. ..... 347/104; 400/578

[58] Field of Search ..... 347/104, 101, 347/1; 400/578, 636, 641, 624, 625, 629, 636.2, 636.3, 637.6; 355/308

[56] References Cited

U.S. PATENT DOCUMENTS 5,480,247 1/1996 Saikawa et al. ..... 400/629
5,506,606 4/1996 Saikawa et al. ..... 346/104
5,567,069 10/1996 Suzuki et al. ..... 347/104

*Primary Examiner*—John Barlow
*Assistant Examiner*—Michael Brooke
*Attorney, Agent, or Firm*—Fitzpatrick, Cella, Harper & Scinto

[57] ABSTRACT

A sheet feeding apparatus includes a discharge rotary body, a pinch rotary body, a drive transmission rotary body and a regulation member. The discharge rotary body feeds and discharges a sheet from a recording section. The pinch rotary body is disposed facing the discharge rotary body for pinching and feeding the sheet along the discharge rotary body. The drive transmission rotary body has a circumferential surface contacting a circumferential surface of the discharge rotary body with a pressure exerted in a direction different from a straight line drawn between rotary centers of the discharge rotary body and the pinch rotary body, for rotationally driving the discharge rotary body. The regulation member contacts the discharge rotary body when deformation of the discharge rotary body exceeds a predetermined quantity arising due to pressure from the drive transmission rotary body and regulates deformation of the discharge rotary body from exceeding the predetermined quantity.

58 Claims, 12 Drawing Sheets

SHEET FEEDING APPARATUS AND RECORDING APPARATUS

BACKGROUND OF THE INVENTION

1. Field of the Invention

This invention relates to a sheet feeding apparatus for feeding sheets by rotary bodies and a recording apparatus equipped with the sheet feeding apparatus and, more particularly, to a sheet feeding apparatus, a recording apparatus and the like capable of preventing a discharge rotary body from deforming.

2. Description of Related Art

Recording apparatuses such as printers, photocopiers, facsimile machines, and the like, or as output machines for composite electronics apparatus including computers and the like or for work stations, ordinarily include plural rollers for feeding sheets, to guide the sheets to a recording section at which recording means is provided and to feed the sheets out of the recording section. FIG. 12 shows a serial type ink jet recording apparatus as a recording apparatus thus having plural rollers for feeding sheets. In the recording apparatus, a feeding roller 50 feeds onto a platen 51 a recording sheet, to which images are recorded by serially scanning an ink jet recording head 52, and then the recording sheet is discharged outside the apparatus by a discharge roller 53.

Regarding drive power transmission to the feeding roller 50 and the discharge roller 53, a transmission roller 54 resiliently urged in arrow K direction by a spring or the like is made to contact both of the feeding roller 50 and the discharge roller 53, and the drive power transmitted from a power source not shown to the discharge roller 50 is further transmitted to the discharge roller 53 by way of the transmission roller 54.

Although such mechanism in which the drive power is transmitted to the discharge roller 53 by way of the transmission roller 54 makes the structure simple and has benefit that numbers of parts become unnecessary, the discharge roller 53 always receives force exerted in arrow L direction by contact of the transmission roller 54. This force is around 50 to 60 grams load and not so large, but the discharge roller 53 may be deformed in arrow L direction if receiving force exerted in arrow L direction while left for a long period of time. If the discharge roller 53 is thus deformed, the outer periphery of the roller 53 vibrates much more and may affect the feeding of the recording sheet. Accordingly, the strength of the discharge roller 53 needs to be durable against the load exerted from the transmission roller 54. However, where compact and inexpensive recording apparatuses are in demand, the discharge roller 53 may lose the strength when made with a smaller diameter thereof. Otherwise, the discharge roller 53 made of a particular material having such a strength that the discharge roller 53 is prevented from becoming deformed may increase the costs for the roller, so that it still remains as a problem to design recording apparatuses compact and inexpensive.

SUMMARY OF THE INVENTION

This invention is created in seeking solution to those problems, and has an object to provide a compact and inexpensive sheet feeding apparatus and recording apparatus in which a discharge rotary body is hardly deformed by a load exerted from a drive transmission rotary body.

It is another object of the invention to provide a compact sheet feeding apparatus and recording apparatus capable of preventing sheet feeding accuracy from being impaired by regulating deformation of a discharge rotary body with a regulating member even where the discharge rotary body is made smaller, as well as capable of producing high definition images.

It is yet another object of the invention to provide a sheet feeding apparatus including: a discharge rotary body for feeding and discharging a sheet from a recording section; a pickup rotary body disposed in facing the discharge rotary body for picking up and feeding the sheet along the discharge rotary body; a drive transmission rotary body having a circumferential surface contacting a circumferential surface of the discharge rotary body with a pressure exerted in a direction different from a straight line drawn between the rotary centers of the discharge rotary body and the pickup rotary body, for rotationally driving the discharge rotary body; and a regulation member for regulating deformation of the discharge rotary body due to pressured contact between the circumferential surfaces of the discharge rotary body and the drive transmission rotary body.

It is still further object of the invention to provide a recording apparatus including the construction for feeding sheet thus constituted, a platen for holding the sheet at the recording section at which the sheet is recorded, and a feeding rotary body for feeding the sheet on an upstream side of the recording section, wherein the platen is held by the feeding rotary body and forms the regulation member by a part thereof.

It is yet a further object of the invention to provide an ink jet recording apparatus including the construction for feeding sheet thus constituted, a platen for holding the sheet at the recording section at which the sheet is recorded, a feeding rotary body for feeding the sheet on an upstream side of the recording section, and a head mounting portion, in facing the platen, recording means for recording the sheet by ink discharged from an ink outlet.

DETAILED DESCRIPTION OF THE PREFERRED EMBODIMENTS

Hereinafter, as a recording apparatus to which this invention can apply, an embodiment of the invention is described using a serial type ink jet recording apparatus. It is to be noted that the ink jet recording apparatus as an embodiment of a recording apparatus to which this invention can apply, is an ink jet recording apparatus mounting an ink jet head onto a head mounting portion and discharging ink from an ink outlet or orifice of the ink jet head toward the recording medium brought to a recording section and can include, as its recording means, a mechanism in which an ink jet head and an ink tank for supplying ink to the ink jet head are unitedly formed and mounted to the head mounting portion, in which, where an ink jet head and an ink tank are formed separately, the ink jet head has an ink tank holder for holding the ink tank and is mounted to the head mounting portion, or in which the ink jet head only is mounted to the head mounting portion while the ink tank is provided on a side of the recording apparatus body. The ink jet heads mounted to those head mounting portions can be a so-called full line type ink jet head in which ink outlets are arrayed across the overall width of the recording medium in a direction crossing to the feeding direction of the recording medium brought into the recording section, or a so-called serial type ink jet head mounted to a carriage as the head mounting portion for recording a line or several lines by reciprocally moving in a direction crossing to the feeding direction of the recording medium brought into the recording section. The recording means may include ink jet head or heads capable of discharging all or a part of black ink, yellow ink, magenta ink, cyan ink, or any other primers. Moreover, the ink jet head thus described can discharge ink or the like from the ink outlet using thermal energy generated by an electrothermal converter, which is disposed in an ink passage in fluid communication with the ink outlet, or using vibrations or volume changes of a piezoelectric device, which is provided in the ink passage.

First Embodiment

Referring to FIGS. 1 to 11, an embodiment of an ink jet recording apparatus using a sheet feeding apparatus according to this invention is described in detail. First, the entire constitution, and then, the constitution of the sheet feeding apparatus are described.

Entire Constitution of the Recording Apparatus

Figure 1:
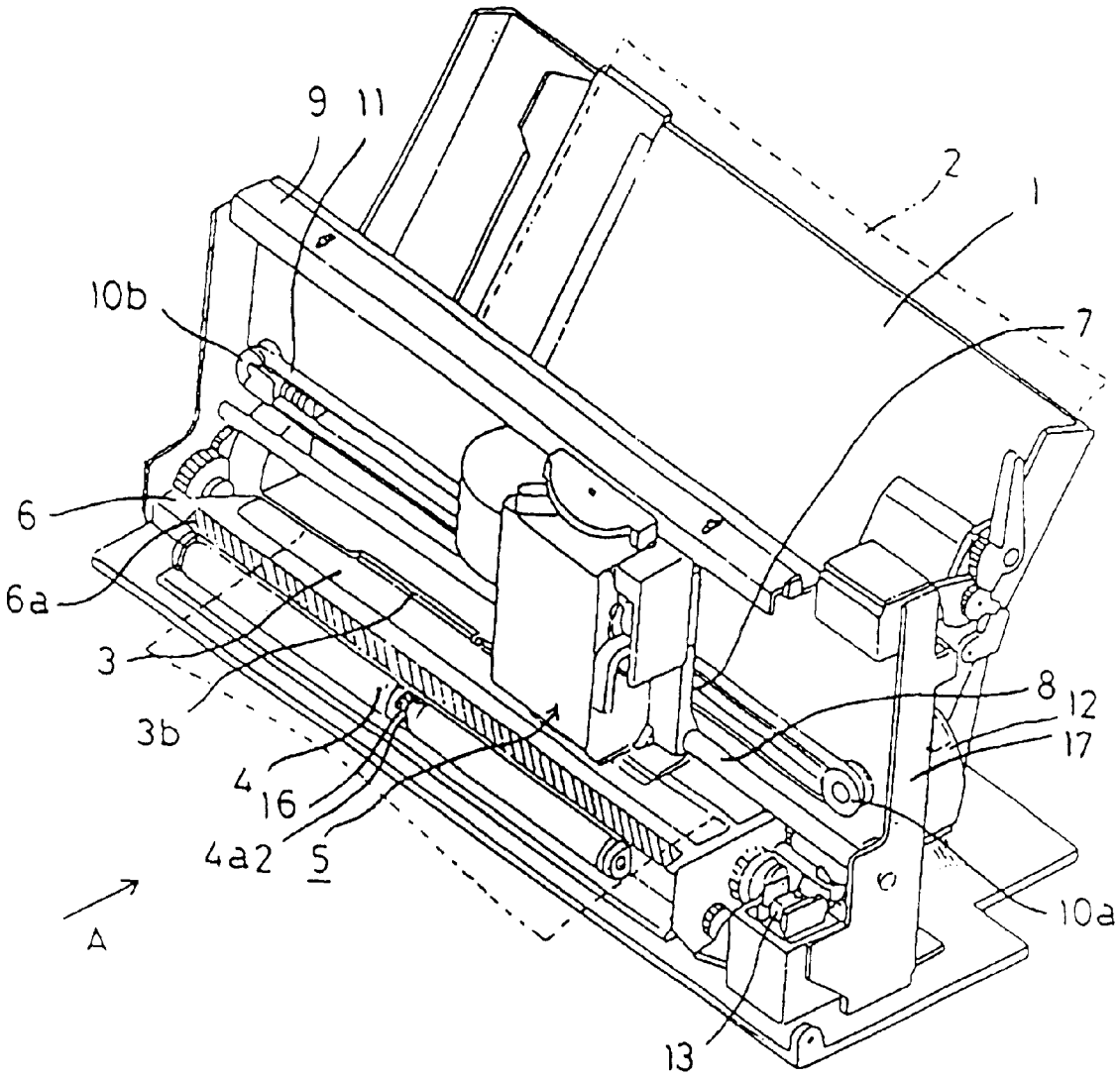
FIG. 1 is an illustration of the entire constitution of an ink jet recording apparatus using a sheet feeding apparatus according to an embodiment of the invention.

This recording apparatus is a recording apparatus for ink jet recording type and as shown in FIG. 1, feeds, sheet by sheet, sheets 2 set in a paper tray 1 in cooperation of a pickup roller not shown, and the sheets 2 are then fed by a sheet feeding apparatus constituted of a feeding roller pair 3 and a discharge roller pair 4. In synchronism with this feeding, recording means disposed between the feeding roller pair 3 and the discharge roller pair 4 records in a prescribed manner, and the recording medium or sheets 2 are discharged outside the apparatus after images are recorded.

The recording means employs an ink jet recording method. In the recording means, an ink jet cartridge 5 of a disposable type in which a recording head 5*a* and an ink tank 5*b* are formed in a united body and a platen 6 are facing each other. The cartridge 5 is mounted on a carriage 7, which is slidable along a guide shaft 8 and a guide rail 9 and engages an endless shaped timing belt 11 tensioned between pulleys 10*a*, 10*b* arranged around both ends of the guide shaft 8. The carriage 7 reciprocally moves in a direction crossing to the feeding direction of the recording sheet 2 when a carriage motor 12 drives the pulley 10*a*. The recording head, during this movement, discharges ink according to image signals, thereby recording in a prescribed manner on the recording sheet 2 supported by the platen 6 from the back side of sheet 2.

The recording head of the ink jet type used for this embodiment includes, as a constitution for discharging ink, liquid outlets (orifices) which are normally fine, liquid passages, energy operating portions formed at a part of the passages, and energy generating means for generating droplet forming energy to be operated to the liquid located at the operating portion.

As the energy generating means for generating such energy, some recording method using an electromechanical converter such as a piezoelectric device or the like, using energy generating means in which an electromagnetic wave such as laser beam is emitted to produce heat which operates to discharge droplets, or using energy generating means in which liquid is heated by an electrothermal converter such as a thermal device having a heat generating resistor and is discharged, is used.

The recording head used for the ink jet recording method in which liquid is discharged by thermal energy, among them, can arrange with a high density the liquid outlets (orifices) for forming droplets upon discharging the droplets for recording, and therefore can record with a high resolution. The recording head using an electrothermal converter as the energy generating means, among them, can be made compact easily, can adequately capitalize the progress in the technology in the latest semiconductor field and utilize the merits of IC (Integrated Circuit) technology and microfabrication technology in which reliability has been improved significantly, can be applicable for high density assemblies, and can render the manufacturing costs thereof inexpensive as well, so that the head is advantageous.

The recording head of the embodiment has multiple nozzles and produces ink images on the recording sheet 2 by discharging ink from the outlet located on the tip of each nozzle according to film boiling pressure created in ink by heat selectively generated by the electrothermal converters provided in the nozzles. The carriage 7 takes a home position (right end of traveling area in FIG. 1) during a recording waiting situation and makes the ink jet cartridge 5 wait at the home position. Capping means 13 for the recording head is arranged at that position, thereby preventing the nozzles of the recording head located at the home position from drying.

Constitution of the Sheet Feeding Apparatus

Figure 2:
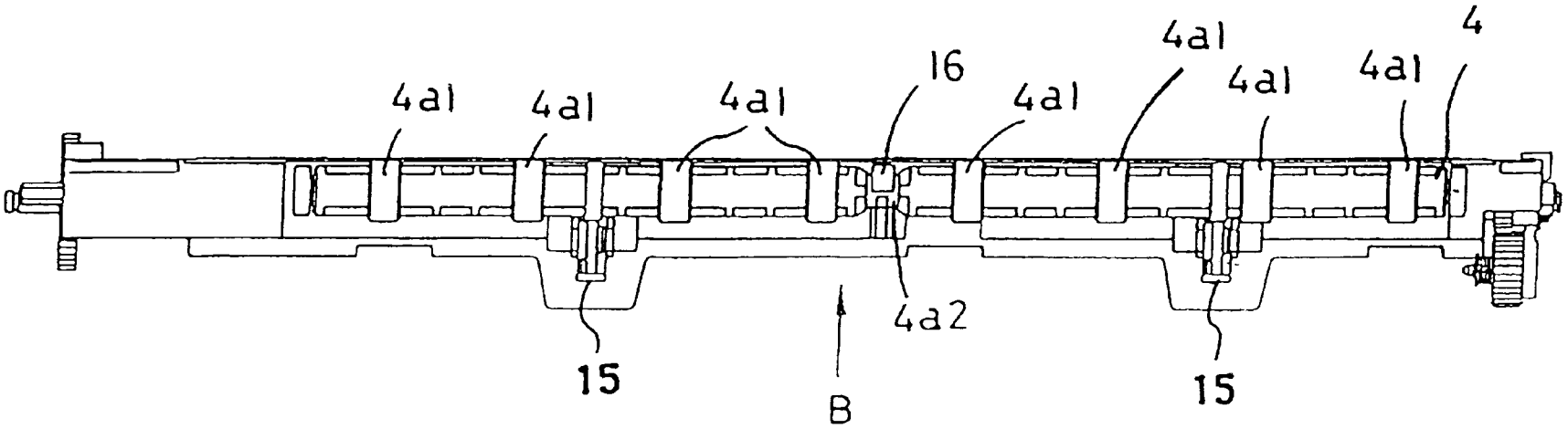
FIG. 2 is an illustration of a discharge roller pair and its vicinity when seen in arrow A direction in FIG. 1.
Figure 3:
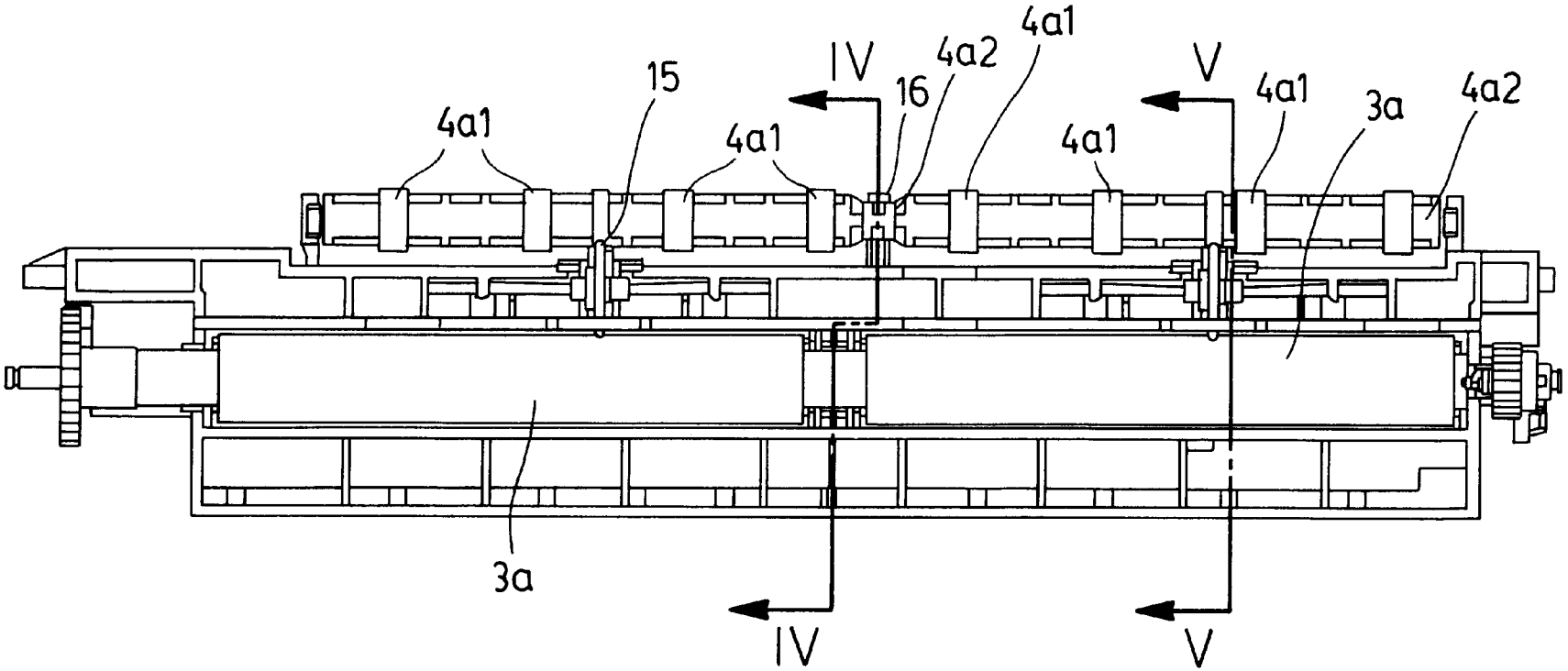
FIG. 3 is an illustration of the discharge roller pair and its vicinity when seen in arrow B direction in FIG. 2.
Figure 4:
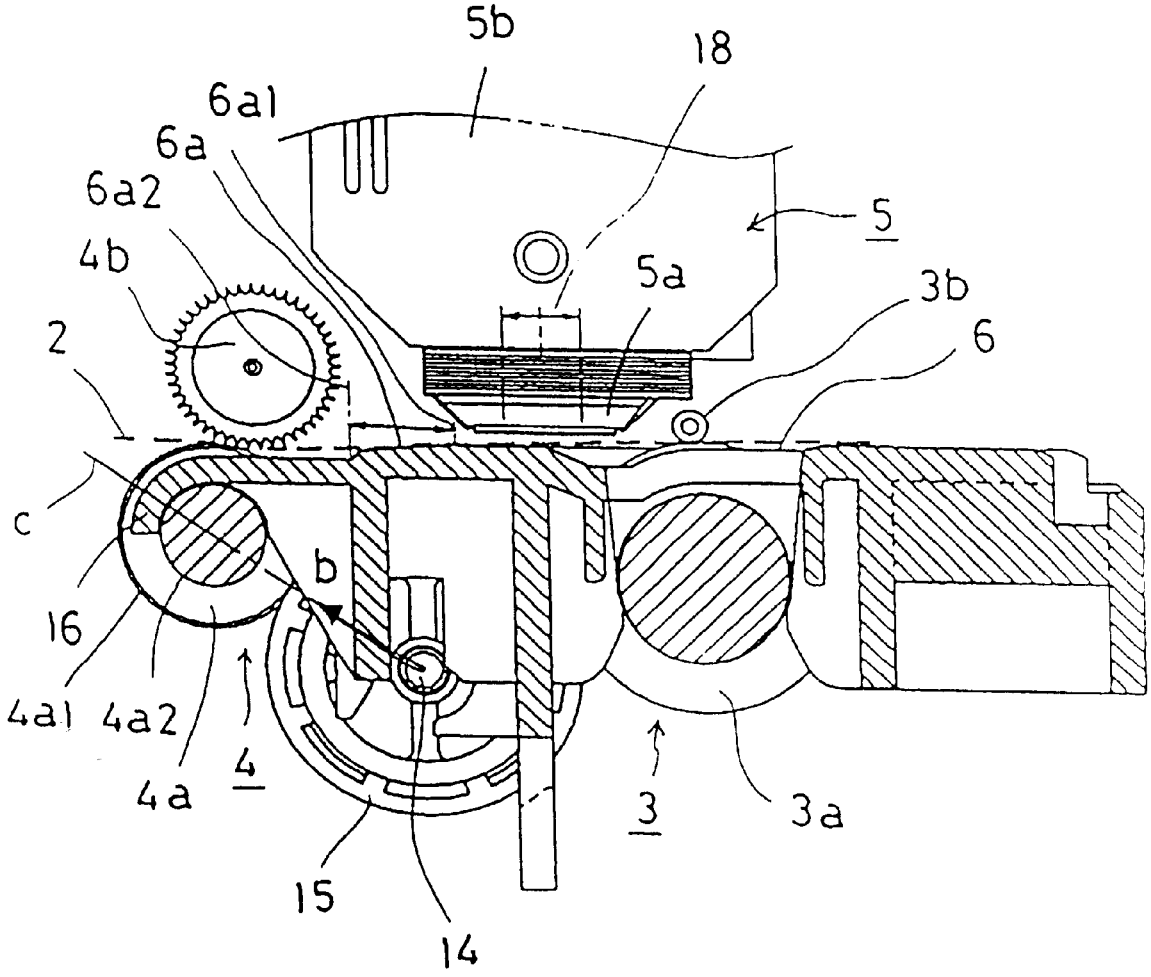
FIG. 4 is an illustration of a cross section cut along C—C line in FIG. 3.
Figure 5:
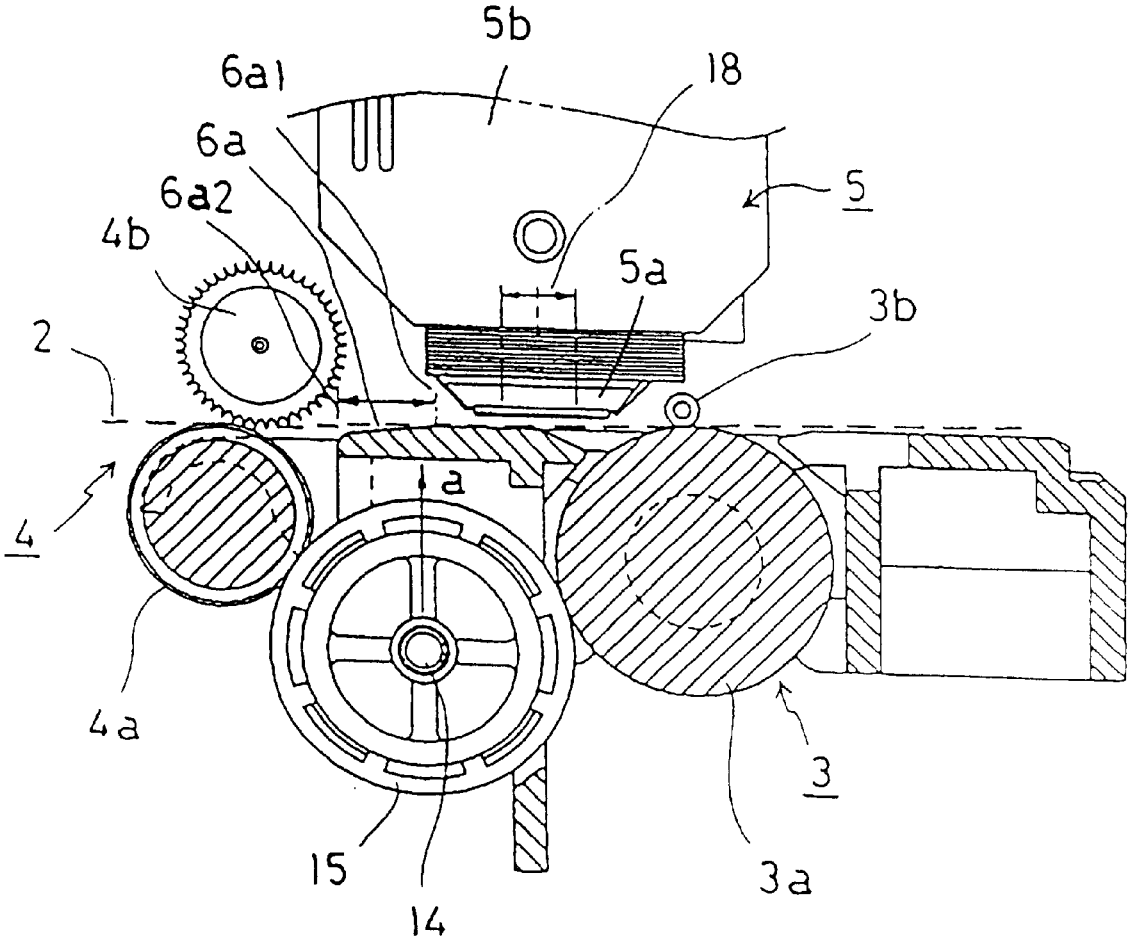
FIG. 5 is an illustration of a cross section cut along D—D line in FIG. 3.
Figure 6:
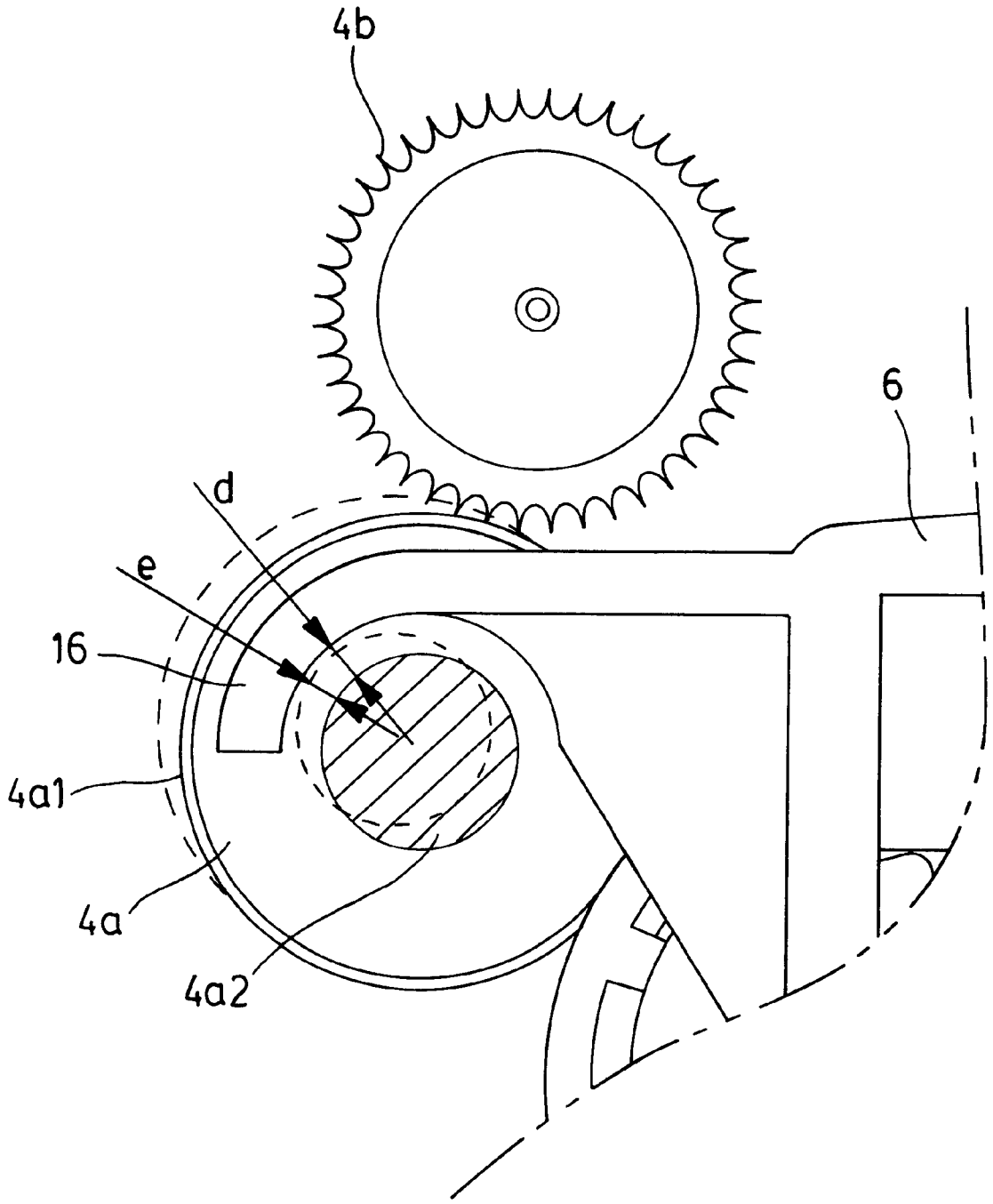
FIG. 6 is an illustration of the discharge rollers, a regulation member and their vicinity.

Referring to FIGS. 2 to 11, the constitution of the sheet feeding apparatus is shown. FIG. 2 is an illustration of the discharge roller pair 4 and its vicinity when seen in arrow A direction in FIG. 1; FIG. 3 is an illustration of the discharge roller pair and its vicinity when seen in arrow B direction in FIG. 2; FIG. 4 is an illustration of a cross section cut along IV—IV line in FIG. 3; FIG. 5 is an illustration of a cross section cut along V—V line in FIG. 3; FIG. 6 is an illustration of the discharge rollers, a regulation member and their vicinity.

The recording sheet 2 is, as described above, to be fcd by the feeding roller pair 3 and the discharge roller pair 4. As shown in FIG. 5, the feeding roller pair 3 is constituted of a feeding roller 3*a*, as a feeding rotary body, receiving drive power from a motor not shown to be rotated and of a follower roller 3*b* rotationally driven by pushing the recording sheet 2 onto the feeding roller 3*a*, thereby conveying the supplied recording sheet 2 to be fed on the platen 6.

The platen 6 is supported in a way that both ends thereof in a longitudinal direction are, from an upper side thereof, engaged respectively to bearings located on both ends of the feeding roller 3*a*. The platen 6 is constituted as to be positioned on an apparatus body frame in maintaining the set position by contacting projections (not shown) formed on the platen 6 to predetermined positions on the apparatus body frame even where the feeding roller 3*a* rotationally drives. Thus, the platen 6 is not attached to the apparatus body frame in a manner directly secured thereto, so that the platen 6 is never bent even when the apparatus body frame is caused to bend by load during drive of the apparatus, so that the platen 6 can avoid from deforming, and so that the apparatus ensures the flatness to guide recording sheets to be fed.

On the other hand, the discharge roller pair 4 is constituted of a discharge roller 4*a* as a discharge rotary body rotating upon transmission of drive power and of a spur 4*b* driven to rotate in pushing the recording sheet 2 onto the roller 4*a*. The discharge roller pair 4 serves for discharge of the recording sheets 2 after recording. The spur 4*b* is a rotary body having a small contact area to the recording sheets 2 and capable of pushing the recording sheets 2 to the discharge roller 4*a* without interfering the ink images even in contacting the recorded ink images.

A transmission roller 15, as a drive transmission rotary body, in which a spring 14 resiliently urges the roller 15 in arrow a direction in FIG. 5 is, by its circumferential surface, in pressured contact with both circumferential surfaces of the feeding roller 3*a* and the discharge roller 4*a* and transmits the drive power transmitted from a motor not shown to the feeding roller 3*a* and further to the discharge roller 4*a* through itself.

The discharge roller 4*a* is, as shown in FIGS. 1, 2, extending in a width direction of the recording sheets 2 to be fed (or in a crossing direction to the sheet feeding direction), and as shown in FIG. 2, low rigid or sheet contact portions 4*a*1 are arranged on the roller 4*a* in being spaced with each other of a predetermined interval in the longitudinal direction of the roller 4*a*. The sheet contact portions 4*a*1 are in contact with the recording sheets 2 to be discharged and are made by fitting rubber rings or attaching thermoplastic elastomer material by bicolor or outsert molding and arc portions having less-hardness than other portion of the discharge roller 4*a*. A small diameter portion 4*a*2 is formed around the center of the discharge roller 4*a* in the longitudinal direction thereof with a smaller diameter than the outer diameter size of the sheet contact portions 4*a*1 to which the recording sheets 2 contact.

The discharge roller 4*a* is urged by the transmission roller 15, as described above, in a direction of arrow a in FIG. 5. The discharge roller 4*a* receives a weight load from the transmission roller 15 in a normal direction of the point at which the discharge roller 4*a* contacts the transmission roller 15, or in a direction of arrow b in FIG. 4. This load is more than 70 grams and less than 90 grams, relatively small and does not form force to deform the discharge roller 4*a* in a moment. However, if the load is made left for a long period of time and is exerted to the roller 4*a*, the discharge roller 4*a* may be deformed. When the deformation is large, the recording sheets 2 fed by the discharge roller 4*a* may move up and down, thereby having a possibility to make the ink jet recording head 5*a* and the recording sheets 2 contact to each other.

In this embodiment, as shown in FIG. 4, a regulation member 16 in a hook shape is provided at a position of the small diameter portion 4*a*2 of the discharge roller 4*a* to solve the problem above. The regulation member 16 constitutes a part of the platen 6 supported at the feeding roller 3*a* in the manner described above and is in contact with the circumferential surface of the discharge roller 4*a* with a predetermined circumferential angle at a position on an extension line c drawn between the rotary centers of the transmission roller 15 and the discharge roller 4*a* or so beyond the position on the extension line c as to cover the small diameter portion 4*a*2 of the discharge roller 4*a*. The regulation member 16 is arranged around the center of the discharge roller 4*a* in the longitudinal direction thereof, and when the discharge roller 4*a* tends to be deformed due to the weight load received from the transmission roller 15, the small diameter portion 4*a*2 of the discharge roller 4*a* contacts the lower portion of the regulation member 16, thereby restricting further deformations. Accordingly, the regulation member 16 can surely prevent the discharge roller 4*a* from deforming due to the weight load received from the transmission roller 15.

It is important that the ink jet recording head 5*a* and the recording sheet 2 maintain a constant space between them (normally about 1 millimeter) in the recording section and do not contact to each other. Since the recording sheets 2 do not move up and down due to deformation of the discharge roller 4*a* (deformation in a different direction from the axial direction) on the downstream side of the recording section, the apparatus can obtain the non-contact state in which the ink jet recording head 5*a* and the recording sheet 2 maintain a constant space between them (normally about 1 millimeter) in the recording section.

The regulation member 16 is disposed at a position such that the top of the member 16 does not contact the recording sheet 2 discharged by the discharge roller 4*a*, or at a position lower than the outer periphery of the sheet contact portions 4*a*1 of the discharge roller 4*a*. The regulation member 16, therefore, will not affect the recording sheets 2 to be fed. The regulation member 16 allows the discharge roller 4*a* to be readily mounted to the apparatus from the lower side since the regulation member 16 is open at its lower side.

Referring now to FIG. 6, relation between the regulation member 16 and the discharge roller 4*a* is described. The discharge roller 4*a* has a span of 210 millimeters and is supported by its both ends. Whole portion except sheet contact portion 4*a*1 of discharge roller 4*a* is a member made of ABS (acrylonitrile-butadiene-styrene), polycarbonate, polyacetal, and the small diameter portion 4*a*2 is a member having a diameter of 6 millimeters (namely, in this embodiment, designed in a range of 5.95 to 6.00 millimeters). The regulation member 16 is arranged in a non-contact state with space d to the outer periphery of the small diameter portion 4*a*2 of the discharge roller 4*a*. The space d is set to meet a range of $e \leqq d \leqq (3/2)e$ where e represents the maximum deformation amount permissible as for individual parts of the discharge roller 4*a*. The maximum deformation amount e is in this specification defined by the differential amount between the closest and farthest points of the circumferential surface of the roller 4*a* with respect to the members facing the circumferential surface of the roller 4*a*.

In this invention, any space d is permissible as far as the range of $e \leqq d \leqq (3/2)e$ is met where e is the maximum deformation amount. For example, if the permissible maximum deformation amount e of the discharge roller 4*a* is 0.2 millimeter, the space d of the regulation member 16 with respect to the discharge roller 4*a* is set to a range of 0.2 millimeter$\leqq d \leqq$0.3 millimeter. The discharge roller 4*a* becomes hardly deformed due to the weight load received from the transmission roller 15 by making the set value of the space d closer as much as possible to the deformation amount e.

The platen 6 in this embodiment is, as shown in hatching in FIG. 1, formed on a front side (to which the recording sheet contacts) thereof with an inclined surface portion 6*a* beginning at a downstream side of the recording section 18 of the recording head in the sheet feeding direction (hereinafter simply referred to as "downstream") and getting lowered on the downstream side. Regarding the inclined surface portion 6*a*, as shown in FIG. 4, the length from a start point portion 6*a*1 to an end point 6*a*2 of the inclined surface portion 6*a* is set to 6 millimeters in this embodiment; the difference between the high and low points is 0.5 millimeter; the surface 6*a* is formed to be lowered moving toward to the downstream side.

In the ink jet recording apparatus, it is confirmed that the recording sheet 2 after recording may corrugate or cockle upward or downward with respect to the recording face when recording duty is high, and this phenomenon is called "cockling." When such cockling occurs, this affects even unrecorded areas of the recording sheet 2. More specifically, the recording sheet 2, when cockled, changes the distance between the nozzle of the ink jet head and the surface of the recording sheet in the recording section of the recording head, thereby maybe impairing the recording quality.

The inclined surface portion 6*a* serves for preventing cockling. Since the surface of the platen 6 is lowered, the recording sheet 2 will cockle only downward even if such cockling occurs, so that the nozzle and the surface of the recording sheet may not contact to each other, it is to be noted that the inclined surface portion 6*a* may be formed on the downstream side of the recording section 18 and such a downstream portion may be adequate if the minimum plane is guaranteed which is capable of supporting the recording sheet 2 when the recording sheet 2 is recorded.

The regulation member 16 described above is formed on the downstream side of the end point 6*a*2 of the inclined surface portion 6*a*, and the top surface of the regulation member 16 is formed at a lower position than the end point 6*a*2 of the inclined surface portion 6*a*, so that the regulation member 16 will never affect the recording sheets 2 fed over the inclined surface portion 6*a*.

Figure 7:
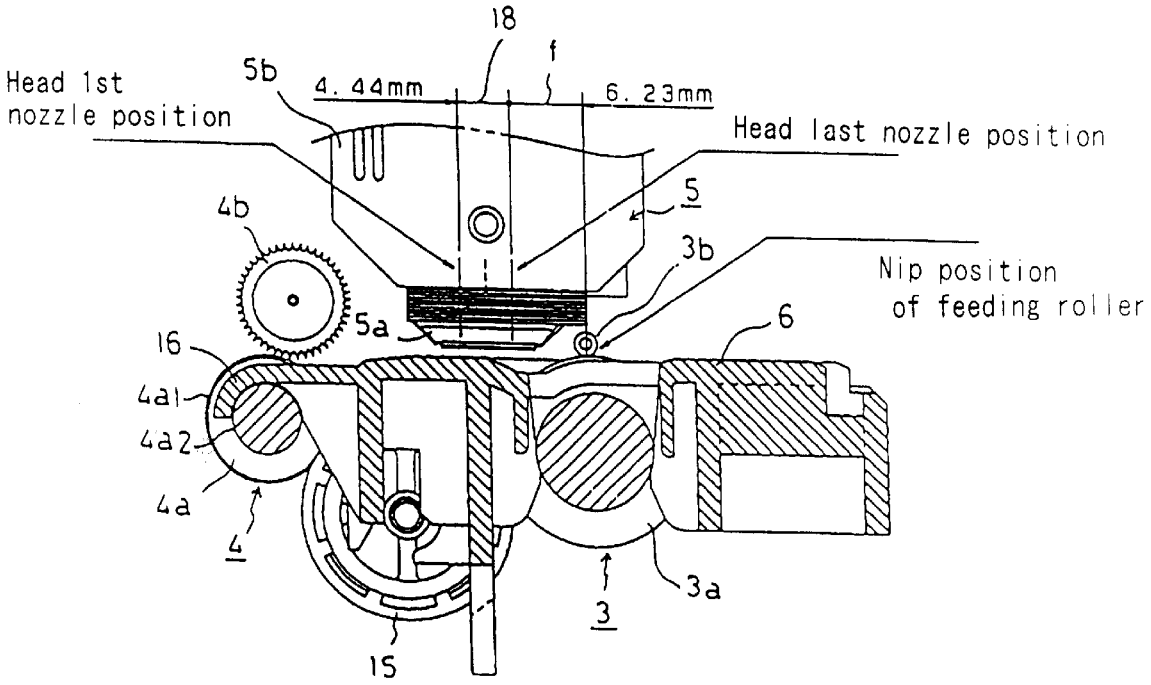
FIG. 7 is an illustration showing relation between the nip position of a feeding roller pair and the recording section of a monochrome recording head.

Referring to FIG. 7, relation between a nip position of the recording sheet 2 by means of the feeding roller 3*a* and the follower roller 3*b* and the recording section 18 of the recording head 5*a* is described. The recording head 5*a*, as described above, is integrated with the ink tank 5*b* to form the ink jet cartridge 5 as a united body, which is replaceable. The recording head 5*a* in this embodiment has sixty-four nozzles to discharge ink; the nozzles are arrayed with equal space between them in the same direction to the sheet feeding direction (pitch between the nozzles is about 0.0705 millimeter in this embodiment). Accordingly, when the farthest nozzle from the nip position of the feeding roller pair 3 is called as to the first nozzle, the distance from the first nozzle to the last nozzle, or sixty-fourth nozzle, is about 4.44 millimeters. The area recorded by one nozzle column of the 4.44 millimeter-length corresponds to the recording area 18 of the recording head 5*a* in this embodiment. In this embodiment, a distance f from the nip position of the feeding roller pair 3 to the last nozzle position of the recording head 5*a* is about 6.23 millimeters, and whether the apparatus can record stably from the rear end of the recording sheet 2 to any front portion is dependent on the distanced. In the following description, ink is discharged from the recording head 5*a* carried on and moved with the carriage, and an area on which image is recorded on the recording sheet 2 is referred as to recordable area.

When the distance from the rear end of the recordable area of the recording sheet 2 to the sheet rear end is longer than the distance f from the nip position of the feeding roller pair 3 to the last nozzle position of the recording head 5*a* (6.23 millimeters in this embodiment), for example, when it is 7 millimeters, the apparatus can record stably because the rear end of the recording sheet 2 is held between the feeding roller 3*a* and the follower roller 3*b* when the recording head 5*a* records images on the recording sheet 2. Such a stable recording can be made up to the position of 7 millimeters from the rear end of the recording sheet 2 on the downstream side in the sheet feeding direction in a situation that the rear end of the recording sheet 2 is held between the feeding roller 3*a* and the follower roller 3*b*, when the recording head 5*a* is for monochrome or mono-color, or namely, when an ink jet cartridge ("monochrome cartridge") having a black ink is used.

If a full color or multicolor image is to be recorded under the condition as described above, the monochrome cartridge must be replaced with an ink jet cartridge unitedly having respective inks of yellow, magenta, and cyan ("full color cartridge"). Now, referring to FIGS. 8, 9, relation between a nip position of the recording sheet 2 by means of the feeding roller 3*a* and the follower roller 3*b* for the full color recording and the recording section 18 of the recording head 5*a* incorporating the full color cartridge is described.

Figure 8:
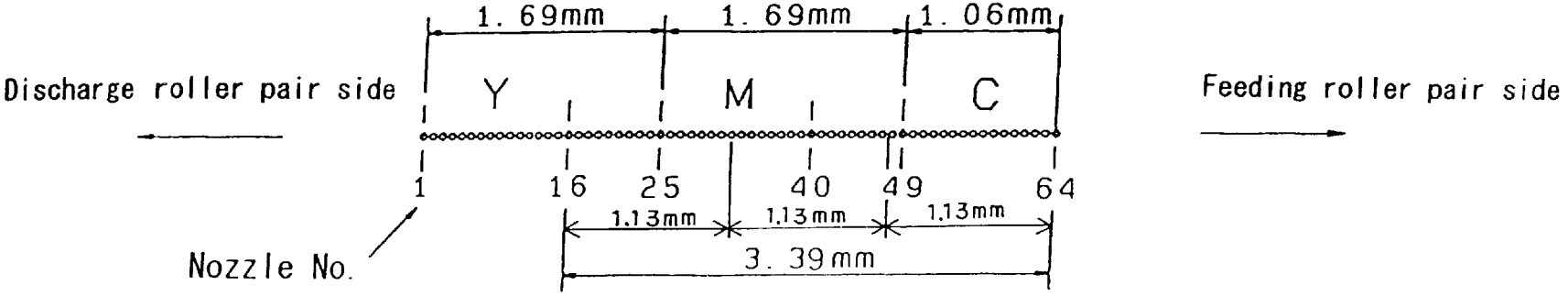
FIG. 8 is an illustration of a nozzle array of a full color ink jet head.

Although the sixty-four nozzles are arrayed with equal space between them in the sheet feeding direction and all nozzles discharge the same color ink in the recording head of the monochrome cartridge shown in FIG. 7, sixty-four nozzles similarly are arrayed with equal space between them in the sheet feeding direction in the recording head of the full color cartridge. The recording head 5*a* of the full color cartridge uses, among the sixty-four nozzles, as shown in FIG. 8, first to sixteenth, sixteen nozzles located on the discharge roller side for discharging yellow (Y) ink, twenty-fifth to fortieth, sixteen nozzles for discharging magenta (M) ink, forty-ninth to sixty-fourth. sixteen nozzles for discharging cyan (C) ink. The full color images are formed by superposing on the recording sheets inks in the order of cyan, magenta, and yellow in feeding of the recording sheet by a sixteen-nozzle pitch, or pitch feeding every 1.13 millimeters. As shown in FIG. 8, to avoid mixing of colors, no nozzle is used for discharging ink between yellow and magenta and between magenta and cyan, or eight nozzles from the seventeenth nozzle to the twenty-fourth nozzle and eight nozzles from the forty-first nozzle to the forty-eighth nozzle.

Regarding the recording of the full color images, the sixty-fourth nozzle records with the cyan ink onto an arbitrary single pixel on the recording sheet, and then, the recording sheet is fed by 1.13 millimeters toward the discharge roller pair. After feeding of 1.13 millimeters, the thirty-second nozzle records with the magenta ink; subsequently, the recording sheet is fed toward the discharge roller pair again; and then, the sixteenth nozzle records with the yellow ink, thereby forming full color images. To complete a full color image, conversely, the sheet must be fed more extra three pitches (3.39 millimeters in this embodiment) in comparison with the monochrome or mono-color image recording, because the yellow ink has to be recorded finally.

Figure 9:
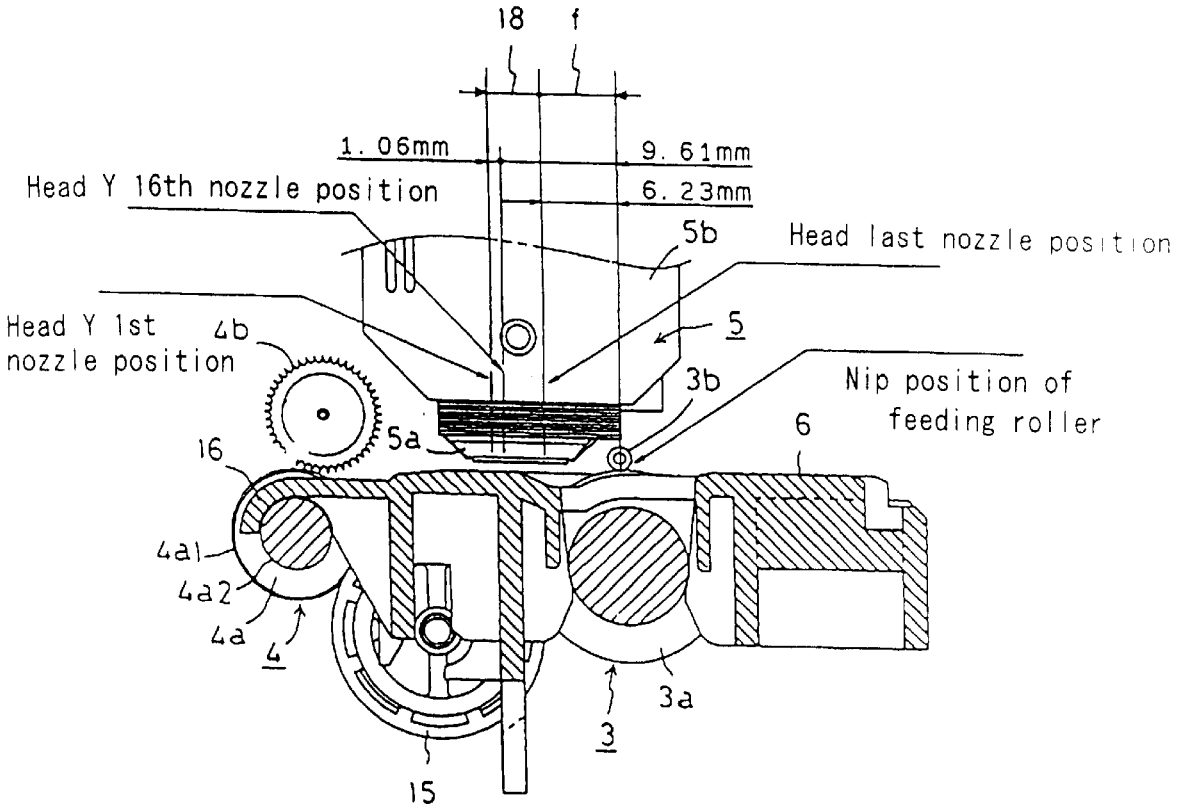
FIG. 9 is an illustration showing relation between the nip position of the feeding roller pair and the recording section of the full color recording head.

For example, when recording is made to the position of 7 millimeters from the rear end of the recording sheet on the downstream side in the sheet feeding direction, the rear end of the recording sheet is held between the feeding roller 3*a* and the follower roller 3*b* until the completion of recording by the last nozzle of the recording head 5*a* (at a position of (7–6.23) from the rear end of the recording sheet on the downstream side in the sheet feeding direction) in the case of the monochrome or mono-color image recording. However, in the case of the full color image recording, as shown in FIG. 9, the full color image will not be completed yet if at least the sixteenth nozzle for discharging the yellow ink of the recording head 5*a* does not operate to record. Since the distance from the nip position of the feeding roller pair 3 to the sixteenth nozzle is 9.61 millimeters, which is longer than the distance of 7 millimeters above, recording may be made in a situation that the rear end of the recording sheet is away from the nip position of the feeding roller pair 3 when recording is made up to the position of 7 millimeters from the rear end of the recording sheet on the downstream side in the sheet feeding direction. In this situation, it may raise a problem that the rear end of the recording sheet would become floating, but such floating of a certain degree may be suppressed by pushing force of the spur 4*b* provided on the downstream side of the recording section 18 of the recording head 5*a*. However, where various recording sheets are used, floating of the rear end of the recording sheet sometimes cannot be suppressed when, e.g., a rigid recording sheet likewise a post card is used.

Figure 10:
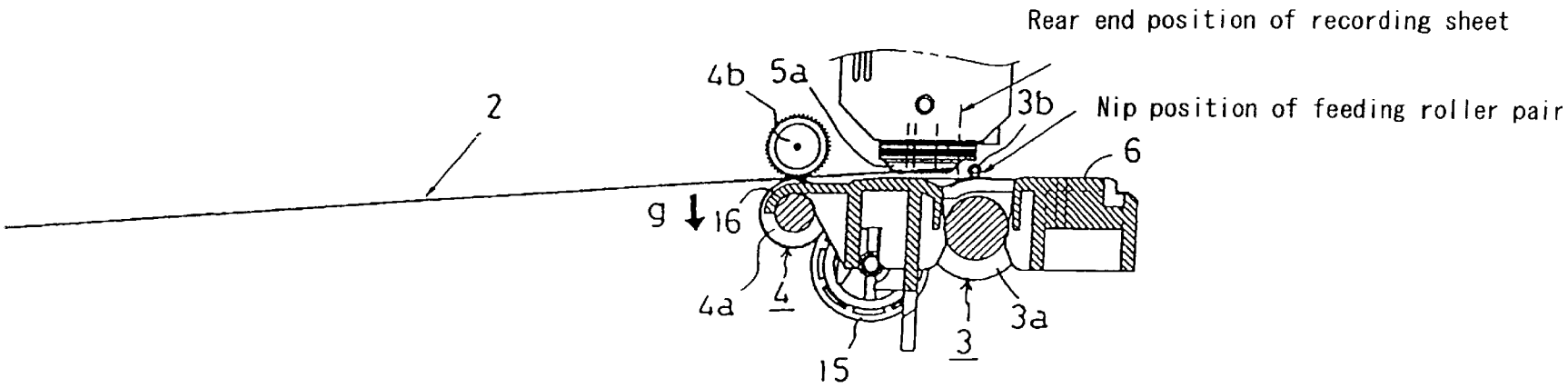
FIG. 10 is an illustration showing relation between pressure of a spur placed on a line extended perpendicularly from the discharge roller and behavior of the recording sheet.
Figure 11:
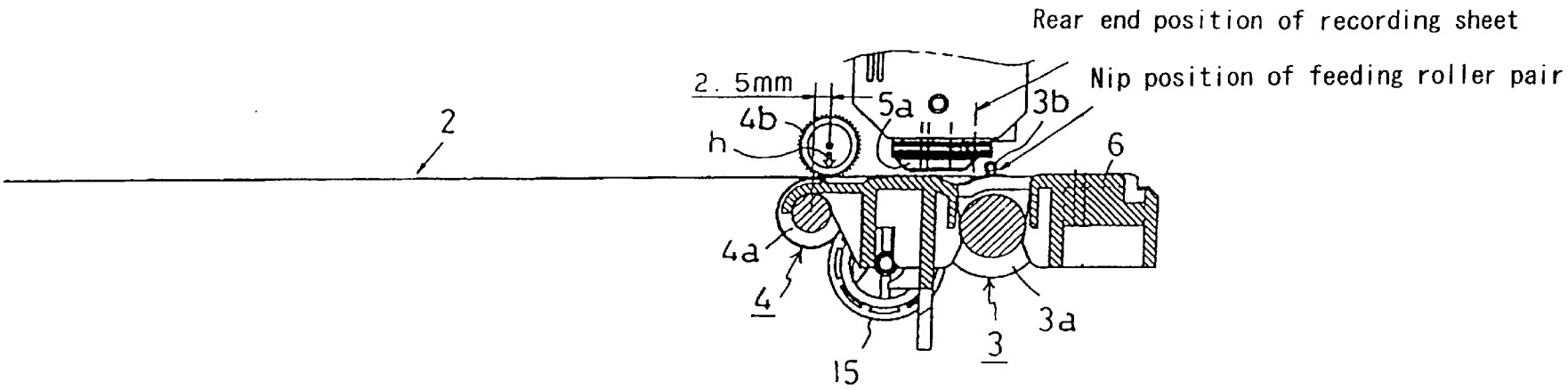
FIG. 11 is an illustration showing relation between pressure of a spur placed out of a line extended perpendicularly from the discharge roller and behavior of the recording sheet.
Figure 12:
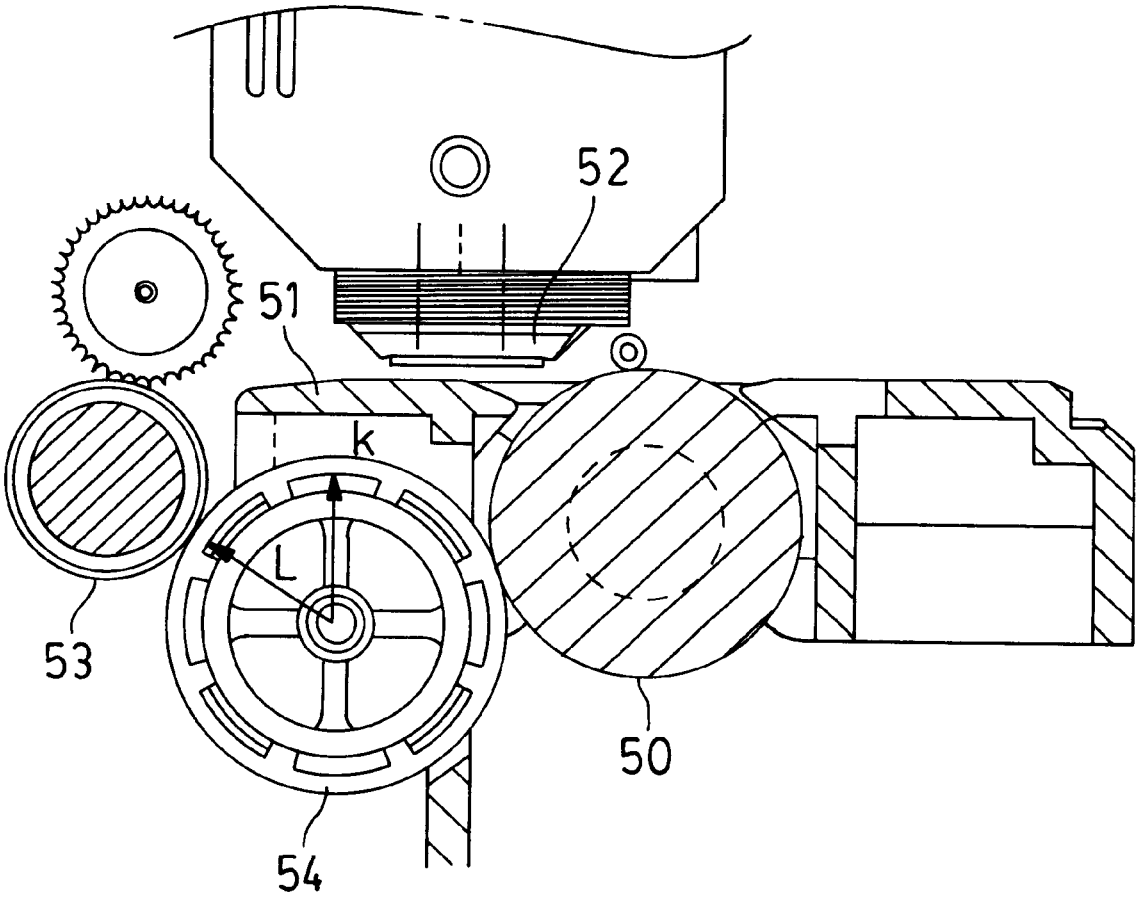
FIG. 12 PRIOR ART
FIG. 12 is an illustration showing a prior art.

Referring to FIGS. 10, 11, a full color image recording is shown in which recording is made on a rigid recording sheet likewise a post card. In FIG. 10, the spur 4*b* is arranged on a vertical line of the discharge roller. If the recording sheet 2 is to be recorded while the sheet 2 is away from the nip position of the feeding roller pair 3 using the apparatus shown in FIG. 10, the recording sheet if rigid likewise a post card may rotate in arrow g direction around a contact point between the discharge roller 4*a* and the spur 4*b* as a rotational center, thereby floating the rear end thereof, possibly contacting the ink discharge face of the recording head 5*a*, because the portion on the downstream side of the contact point is longer than the portion on the upstream side of the point in the recording sheet. The spur 4*b* in this situation pushes the recording sheet 2, but cannot suppress such floating of the read end of the sheet even by pushing force of the spur 4*b*, because the operation point of the pushing force of the spur 4*b* is the identical to the rotational center of the recording sheet 2.

To solve such a problem, in this embodiment as shown in FIG. 11, the spur 4*b* for pushing the recording sheet 2 toward the discharge roller 4*a* is located on an upstream side of the discharge roller 4*a* in the sheet feeding direction. Specifically, the rotational center of the spur 4*b* is shifted by about 2.5 millimeters toward the recording section from the rotational center of the discharge roller 4*a*. The operation point of the pushing force of the spur 4*b* is therefore positioned on the upstream side in the sheet feeding direction of the rotational center of the recording sheet 2. As a result, the pushing force of the spur 4*b* (in arrow h direction in FIG. 11) can suppress the floating of the rear end of the recording sheet 2, thereby allowing the apparatus to stably record even when the rear end of the recording sheet is away from the nip position of the feeding roller pair 3.

As described above, in this embodiment, the regulation member 16 regulates the deformation of the discharge roller 4*a* around the center thereof in the longitudinal direction, so that such deformation due to load of the transmission roller 15 can be suppressed within a quite small amount even where the discharge roller 4*a* is driven by transmission of the transmission roller 15, and so that the deformation on the outer periphery of the discharge roller 4*a* can consequently be suppressed in a quite small amount. Accordingly, an ink jet recording apparatus capable of recording with high definition can be provided.

Since the regulation member 16 for regulating the deformation above is provided at the discharge roller 4*a* which needs strength thereof, the deformation of the discharge roller 4*a* can be suppressed in a quite small amount even when the diameter of the discharge roller 4*a* is made smaller than the prior art. The deformation of the discharge roller 4*a* can be suppressed within a quite small amount even when the roller is made of an ordinary material without using any particular material having strength thereof against such deformation, so that an apparatus recordable with high definition can be made compact readily and be provided inexpensively. More specifically, in this embodiment, since the regulation member 16 and the platen 6 are formed in a united body, the structure can be simplified, thereby simplifying the assembling processes, and reducing the manufacturing costs.

The outer diameter of the discharge roller 4*a* can be made smaller, so that the spur 4*b* located on the upstream side of the discharge roller 4*a* can be placed closer to the recording section 18 of the recording head 5*a*. Therefore, even after the rear end of the recording sheet 3 comes away from the feeding roller 3*a* and the follower roller 3*b*, the recording sheet 2 is held at a position closer to the recording section by the discharge roller 4*a* and the spur 4*b*, thereby enabling the apparatus to record by ink jet in a better way.

More specifically, the spur 4*b* for pushing the recording sheet to the discharge roller 4*a* is shifted on the upstream side of the vertically extended line of the discharge roller 4*a* in the sheet feeding direction, and therefore, the spur 4*b* can prevent the rear end of the recording sheet from floating by the pushing force of the spur even after the rear end of the recording sheet 3 comes away from the nip position of the feeding roller pair 3. As a result, a recording sheet so rigid as likewise a post card can be recorded stably. When recording full color images using the full color cartridge, the apparatus recordable in monochrome or mono-color and multicolor in interchanging the monochrome and full color cartridges having the nozzles arrayed in the same direction as the sheet feeding direction, can stably record on the same area as in the case of the monochrome or mono-color image recording using the monochrome cartridge. Accordingly, the full color ink jet recording apparatus can realize a stable recording onto the same area as the monochrome ink jet recording apparatus, though having the same size as the monochrome or mono-color ink jet recording apparatus.

In the embodiment above, although the regulation member is provided at a single portion around the center of the discharge rotary body and simplifies the structure by being formed in a united body with the platen, the structure of the regulation member is not limited to this, can be arranged at plural portions, and can be formed in a united body with the frame of the recording apparatus. By providing spring means additionally, the regulation member can be urged in the opposite direction to the pushing direction of the transmission roller, as a matter of course.

Other Embodiments

The ink jet recording apparatus described above can be used for an image output terminal apparatus for information process apparatus such as computers, for a photocopier incorporating a scanner or the like, for a facsimile machine having transmitting and receiving functions, and the like.

Although the embodiment above exemplifies that the sheet feeding apparatus constituted of the feeding roller pair 3, the discharge roller pair 4, the regulation member 16, etc. is employed for the ink jet recording apparatus, the sheet feeding apparatus can be used not only for such a recording apparatus but also for other apparatus such as a scanner.

Although in the embodiment above, the ink jet recording type recording apparatus is exemplified as a recording apparatus of a non-contact recording type in which the recording means records in a non-contacting state, this invention is not limited to such apparatuses, and for example, the invention effectuates a recording apparatus, e.g., in which recording is made in a state in non-contacting a sheet using a sublimation type thermal head.

Although the embodiment above exemplifies that the single regulation member for regulating the deformation of the discharge roller is provided around the center in the longitudinal direction thereof, this invention is not limited to this structure, and the regulation members can be provided at plural portions in the longitudinal direction. In that case, the regulation members can be provided in being equally spaced with each other or in being diversified in the longitudinal direction at a single portion at which deformation of the permissible maximum deformation amount of the discharge roller occurs or at a number of portions around the single portion, depending on the length of the discharge roller in the longitudinal direction, positions at which the transmission roller is attached for transmitting the drive power to the discharge roller, and the like.

As described above, the sheet feeding apparatus is formed with the regulation member for regulating deformation of the discharge rotary body according to the embodiment, thereby rendering the regulation member to regulate the deformation of the discharge rotary body even if the discharge rotary body is made smaller, thereby preventing the sheet feeding accuracy from being impaired.

Accordingly, when the sheet feeding apparatus is employed for a recording apparatus such as an ink jet recording apparatus, the apparatus can he made compact and inexpensive as well as obtainable of high definition images.

What is claimed is:

1. A sheet feeding apparatus comprising:

a discharge rotary body for feeding and discharging a sheet from a recording section;

a pinch rotary body disposed facing the discharge rotary body for pinching and feeding the sheet along the discharge rotary body;

a drive transmission rotary body having a circumferential surface contacting a circumferential surface of the discharge rotary body with a pressure exerted in a direction different from a straight line drawn between rotary centers of the discharge rotary body and the pinch rotary body, for rotationally driving the discharge rotary body; and a regulation member contacting the discharge rotary body when deformation of the discharge rotary body exceeding a predetermined quantity arises by pressure from the drive transmission rotary body and regulating deformation of the discharge rotary body from exceeding the predetermined quantity, wherein the regulation member is spaced from the discharge rotary body at a distance d which is set to meet $e \leqq d \leqq (3/2)e$ where e represents a maximum permissible deformation amount for the discharge rotary body.

2. The sheet feeding apparatus according to claim 1, wherein the regulation member regulates deformation of discharge rotary body around the center of the discharge rotary body in a longitudinal direction of the discharge rotary body.

3. The sheet feeding apparatus according to claim 1 or 2, wherein the discharge rotary body is made smaller at a portion at which the regulation member contacts the discharge rotary body than other, portions at which the discharge rotary body contacts the sheet, whereby the regulation member regulating a part of the discharge rotary body is kept away from the sheet.

4. The sheet feeding apparatus according to claim 1, wherein the regulation member regulates, with respect to the rotary axis of the discharge rotary body, the discharge rotary body at an extension line extended from a line drawn between the rotary centers of the discharge rotary body and the drive transmission rotary body or as to cover a position beyond the extension line.

5. The sheet feeding apparatus according to claim 1, wherein the pinch rotary body is disposed on an upstream side of the discharge rotary body in the feeding direction of the sheet.

6. The sheet feeding apparatus according to claim 1, further comprising a carriage for holding recording means having an ink outlet for discharging ink.

7. The sheet feeding apparatus according to claim 6, wherein the recording means discharges ink through the ink outlet using thermal energy generated by an electrothermal converter.

8. A recording apparatus comprising:

a discharge rotary body for feeding and discharging a sheet from a recording section;

a pinch rotary body disposed facing the discharge rotary body for pinching and feeding the sheet along the discharge rotary body;

a drive transmission rotary body having a circumferential surface contacting a circumferential surface of the discharge rotary body with a pressure exerted in a direction different from a straight line drawn between the rotary centers of the discharge rotary body and the pinch rotary body, for rotationally driving the discharge rotary body;

a regulation member contacting the discharge rotary body when deformation of the discharge rotary body exceeding a predetermined quantity arises by pressure from the drive transmission rotary body and regulating deformation of the discharge rotary body from exceeding the predetermined quantity, wherein the regulation member is spaced from the discharge rotary body at a distance d which is set to meet $e \leqq d \leqq (3/2)e$ where e represents a maximum permissible deformation amount for the discharge rotary body;

a platen for holding the sheet at a recording section at which the sheet is recorded; and a feeding rotary body for feeding the sheet on an upstream side of the recording section.

9. The recording apparatus according to claim 8, wherein the platen is held by the feeding rotary body.

10. The recording apparatus according to claim 8, wherein the regulation member is formed as a part of and formed in a united body with the platen.

11. The recording apparatus according to claim 8, wherein the regulation member regulates deformation of the discharge rotary body around the center of the discharge rotary body in a longitudinal direction of the discharge rotary body.

12. The recording apparatus according to claim 8, wherein the discharge rotary body is made smaller at a portion at which the regulation member contacts the discharge rotary body than other portions at which the discharge rotary body contacts the sheet, whereby the regulation member regulating a part of the discharge rotary body is kept away from the sheet.

13. The recording apparatus according to claim 8, wherein the regulation member regulates, with respect to the rotary axis of the discharge rotary body, the discharge rotary body at an extension line extended from a line drawn between the rotary centers of the discharge rotary body and the drive transmission rotary body or as to cover a position beyond the extension line.

14. The recording apparatus according to claim 8, wherein the rotary center of the pinch rotary body is disposed on an upstream side of the rotary center of the discharge rotary body in the feeding direction of the sheet.

15. The recording apparatus according to claim 8, wherein the platen has, at part thereof adjacent the regulation member, an inclined surface portion beginning on a downstream side of the recording section in a sheet feeding direction and the regulation member has at least a top surface, the regulation member is disposed on the downstream side of an end of the inclined surface portion in the sheet feeding direction, and the top surface of the regulation member is placed at a lower position than the end of the inclined surface portion.

16. The recording apparatus according to claim 8, further comprising a carriage for holding recording means having an ink outlet for discharging ink.

17. The recording apparatus according to claim 16, wherein the recording means discharges ink through the ink outlet using thermal energy generated by an electrothermal converter.

18. The recording apparatus according to claim 16, wherein the recording means is a sublimation type thermal head.

19. The recording apparatus according to claim 8, wherein the drive transmission rotary body has a circumferential surface in pressured contact with a circumferential surface of the feeding rotary body to rotationally drive the discharge rotary body by transmitting the rotational drive power of the feeding rotary body to the discharge rotary body.

20. The recording apparatus according to any one of claims 8 to 12 and 13 to 19, wherein the recording apparatus serves as a printer.

21. The recording apparatus according to any one of claims 8 to 12 and 13 to 19, wherein the recording apparatus serves as a facsimile machine.

22. The recording apparatus according to any one of claims 8 to 12 and 13 to 19, wherein the recording apparatus serves as a photocopier.

23. An ink jet recording apparatus comprising:

a discharge rotary body for feeding and discharging a sheet from a recording section;

a pinch rotary body disposed facing the discharge rotary body for pinching and feeding the sheet along the discharge rotary body;

a drive transmission rotary body having a circumferential surface contacting a circumferential surface of the discharge rotary body with a pressure exerted in a direction different from a straight line drawn between rotary centers of the discharge rotary body and the pinch rotary body, for rotationally driving the discharge rotary body;

a regulation member contacting the discharge rotary body when deformation of the discharge rotary body exceeding a predetermined quantity arises by pressure from the drive transmission rotary body and regulating deformation of the discharge rotary body from exceeding the predetermined quantity, wherein the regulation member is spaced from the discharge rotary body at a distance d which is set to meet $e \leqq d \leqq (3/2)e$ where e represents a maximum permissible deformation amount for the discharge rotary body;

a platen for holding the sheet at the recording section at which the sheet is recorded;

a feeding rotary body for feeding the sheet on an upstream side of the recording section; and a head mounting portion, facing the platen, for mounting recording means for recording on the sheet by discharging ink from an ink outlet.

24. The ink jet recording apparatus according to claim 23, wherein the recording means discharges ink from the ink outlet using thermal energy generated by an electrothermal converter.

25. The ink jet recording apparatus according to claim 23, wherein the head mounting portion comprises a carriage for holding and conveying a serial type ink jet head.

26. The ink jet recording apparatus according to claim 23, wherein the head mounting portion holds a full line type ink jet head.

27. A sheet feeding apparatus comprising:

a frame;

a discharge rotary body for feeding and discharging a sheet from a section, the discharge rotary body positioned to cross a feeding direction of the sheet and having plural supported portions supported by the frame;

a pinch rotary body disposed facing the discharge rotary body for pinching and feeding the sheet along the discharge rotary body;

a drive transmission rotary body having a circumferential surface contacting a circumferential surface of the discharge rotary body with a pressure exerted in a direction different from a straight line drawn between rotary centers of the discharge rotary body and the pinch rotary body, for rotationally driving the discharge rotary body; and a regulation member disposed at a position facing a region of the discharge rotary body between any two supported portions of the discharge rotary body without contacting a circumferential surface of the discharge rotary body when deformation of the discharge rotary body does not exceed a predetermined quantity, the regulation member contacting the discharge rotary body when deformation of the discharge rotary body exceeding the predetermined quantity arises by pressure from the drive transmission rotary body and regulating deformation of the discharge rotary body from exceeding the predetermined quantity.

28. The sheet feeding apparatus according to claim 27, wherein the regulation member regulates deformation of discharge rotary body around the center of the discharge rotary body in a longitudinal direction of the discharge rotary body.

29. The sheet feeding apparatus according to claim 27, wherein the discharge rotary body is made smaller at a portion at which the regulation member contacts the discharge rotary body than other portions at which the discharge rotary body contacts the sheet, whereby the regulation member regulating a part of the discharge rotary body is kept away from the sheet.

30. The sheet feeding apparatus according to claim 27, wherein the regulation member regulates, with respect to the rotary axis of the discharge rotary body, the discharge rotary body at an extension line extended from a line drawn between the rotary centers of the discharge rotary body and the drive transmission rotary body or as to cover a position beyond the extension line.

31. The sheet feeding apparatus according to claim 27, wherein the pinch rotary body is disposed on an upstream side of the discharge rotary body in the feeding direction of the sheet.

32. The sheet feeding apparatus according to claim 27, further comprising a carriage for holding recording means having an ink outlet for discharging ink.

33. The sheet feeding apparatus according to claim 32, wherein the recording means discharges ink through the ink outlet using thermal energy generated by an electrothermal converter.

34. A recording apparatus having a recording section which records on a sheet with a recording head mounted on a head mounting portion, comprising:

a frame;

a feeding rotary body for feeding the sheet to the recording section, the feeding rotary body disposed on an upstream side of the recording section;

a platen for guiding the sheet fed by the rotary body, the platen disposed at a position to face the recording head at the recording section;

a discharge rotary body for feeding and discharging the sheet from the recording section, the discharge rotary body positioned to cross a feeding direction of the sheet and having plural supported portions supported by the frame;

a pinch rotary body disposed facing the discharge rotary body for pinching and feeding the sheet along the discharge rotary body;

a drive transmission rotary body having a circumferential surface contacting a circumferential surface of the discharge rotary body with a pressure exerted in a direction different from a straight line drawn between rotary centers of the discharge rotary body and the pinch rotary body, for rotationally driving the discharge rotary body; and a regulation member disposed at a position facing a region of the discharge rotary body between any two supported portions of the discharge rotary body without contacting a circumferential surface of the discharge rotary body when deformation of the discharge rotary body does not exceed a predetermined quantity, the regulation member contacting the discharge rotary body when deformation of the discharge rotary body exceeding the predetermined quantity arises by pressure from the drive transmission rotary body and regulating deformation of the discharge rotary body from exceeding the predetermined quantity.

35. The recording apparatus according to claim 34, wherein the platen is held by the discharge rotary body.

36. The recording apparatus according to claim 34, wherein the regulation member is formed as a part of and formed in a united body with the platen.

37. The recording apparatus according to claim 34, wherein the regulation member regulates deformation of the discharge rotary body around the center of the discharge rotary body in a longitudinal direction of the discharge rotary body.

38. The recording apparatus according to claim 34, wherein the discharge rotary body is made smaller at a portion at which the regulation member contacts the discharge rotary body than other portions at which the discharge rotary body contacts the sheet, whereby the regulation member regulating a part of the discharge rotary body is kept away from the sheet.

39. The recording apparatus according to claim 34, wherein the regulation member regulates, with respect to the rotary axis of the discharge rotary body, the discharge rotary body at an extension line extended from a line drawn between the rotary centers of the discharge rotary body and the drive transmission rotary body or as to cover a position beyond the extension line.

40. The recording apparatus according to claim 34, wherein the rotary center of the pinch rotary body is disposed on an upstream side of the rotary center of the discharge rotary body in the feeding direction of the sheet.

41. The recording apparatus according to claim 34, wherein the platen has, at part thereof adjacent the regulation member, an inclined surface portion beginning on a downstream side of the recording section in a sheet feeding direction and the regulation member has at least a top surface, the regulation member is disposed on the downstream side of an end of the inclined surface portion in the sheet feeding direction, and the top surface of the regulation member is placed at a lower position than the end of the inclined surface portion.

42. The recording apparatus according to claim 34, further comprising a carriage for holding recording means having an ink outlet for discharging ink.

43. The recording apparatus according to claim 42, wherein the recording means discharges ink through the ink outlet using thermal energy generated by an electrothermal converter.

44. The recording apparatus according to claim 42, wherein the recording means is a sublimation type thermal head.

45. The recording apparatus according to claim 34, wherein the drive transmission rotary body has a circumferential surface in pressured contact with a circumferential, surface of the feeding rotary body to rotationally drive the discharge rotary body by transmitting the rotational drive power of the feeding rotary body to the discharge rotary body.

46. The recording apparatus according to any one of claims 34, wherein the recording apparatus serves as a printer.

47. The recording apparatus according to any one of claims 34, wherein the recording apparatus serves as a facsimile machine.

48. The recording apparatus according to any one of claims 34, wherein the recording apparatus serves as a photocopier.

49. A print apparatus having an ink let print section which records on a sheet with an ink jet print head mounted on a head mounting portion, comprising:

a frame;

a feeding rotary body for feeding the sheet to the ink let print section, the feeding rotary body disposed on an upstream side of the ink jet print section;

a platen for guiding the sheet fed by the feeding rotary body, the platen disposed at a position to face the ink let print head at the ink let print section;

a discharge rotary body for feeding and discharging the sheet from the ink let print section, the discharge rotary body positioned to cross a feeding direction of the sheet and having plural supported portions supported by the frame;

a pinch rotary body disposed facing the discharge rotary body for pinching and feeding the sheet along the discharge rotary body;

a drive transmission rotary body having a circumferential surface contacting a circumferential surface of the discharge rotary body with a pressure exerted in a direction different from a straight line drawn between rotary centers of the discharge rotary body and the pinch rotary body, for rotationally driving the discharge rotary body; and a regulation member disposed at a position facing a region of the discharge rotary body between any two supported portions of the discharge rotary body without contacting a circumferential surface of the discharge rotary body when deformation of the discharge rotary body does not exceed a predetermined quantity, the regulation member contacting the discharge rotary body when deformation of the discharge rotary body exceeding the predetermined quantity arises by pressure from the drive transmission rotary body and regulating deformation of the discharge rotary body from exceeding the predetermined quantity.

50. The print apparatus according to claim 49, wherein the ink jet print head discharges ink from an ink outlet using thermal energy generated by an electrothermal converter.

51. The print apparatus according to claim 49, wherein the ink jet print head is a serial print head and the head mounting portion comprises a carriage for holding and conveying the serial ink jet print head.

52. The print apparatus according to claim 49, wherein the ink jet print head is a full line print head and the head mounting portion holds the full line type ink jet print head.

53. A sheet feeding apparatus comprising:

a frame;

a first rotary body for feeding and discharging a sheet from a section, the first rotary body positioned to cross a feeding direction of the sheet and having plural supported portions supported by the frame;

a second rotary body disposed facing the first rotary body for pinching and feeding the sheet along the first rotary body;

a pressure member pressing the first rotary body in a direction different from a straight line drawn between rotary centers of the first rotary body and the second rotary body; and a regulation member disposed at a position facing a region of the first rotary body between any two supported portions of the first rotary body without contacting a circumferential surface of the first rotary body when deformation of the first rotary body does not exceed a predetermined quantity, the regulation member contacting the first rotary body when deformation of the first rotary body exceeding the predetermined quantity arises by pressure from the pressure member and regulating deformation of the first rotary body from exceeding the predetermined quantity.

54. A recording apparatus having a recording section which records on a sheet with a recording head mounted on a head mounting portion, comprising:

a frame;

a feeding rotary body for feeding the sheet to the recording section, the feeding rotary body disposed on an upstream side of the recording section;

a platen for guiding the sheet fed by the feeding rotary body, the platen disposed at a position to face the recording head at the recording section;

a first rotary body for feeding and discharging the sheet from the recording section, the first rotary body positioned to cross a feeding direction of the sheet and having plural supported portions supported by the frame;

a second rotary body disposed facing the first rotary body for pinching and feeding the sheet along the first rotary body;

a pressure member pressing the first rotary body in a direction different from a straight line drawn between rotary centers of the first rotary body and the second rotary body; and a regulation member disposed at a position facing a region of the first rotary body between any two supported portions of the first rotary body without contacting a circumferential surface of the first rotary body when deformation of the first rotary body does not exceed a predetermined quantity, the regulation member contacting the first rotary body when deformation of the first rotary body exceeding the predetermined quantity arises by pressure from the pressure member and regulating deformation of the first rotary body from exceeding the predetermined quantity.

55. A print apparatus having an ink jet print section which records on a sheet with an ink jet print head mounted on a head mounting portion, comprising:

a frame;

a feeding rotary body for feeding the sheet to the ink jet print section, the feeding rotary body disposed on an upstream side of the ink let print section;

a platen for guiding the sheet fed by the feeding rotary body, the platen disposed at a position to face the ink jet print head at the ink jet print section;

a first rotary body for feeding and discharging the sheet from the ink jet print section, the first rotary body positioned to cross a feeding direction of the sheet and having plural supported portions supported by the frame;

a second rotary body disposed facing the first rotary body for pinching and feeding the sheet along the first rotary body;

a pressure member pressing the first rotary body in a direction different from a straight line drawn between rotary centers of the first rotary body and the second rotary body; and a regulation member disposed at a position facing a region of the first rotary body between any two supported portions of the first rotary body without contacting a circumferential surface of the first rotary body when deformation of the first rotary body does not exceed a predetermined quantity, the regulation member contacting the first rotary body when deformation of the first rotary body exceeding the predetermined quantity arises by pressure from the pressure member and regulating deformation of the first rotary body from exceeding the predetermined quantity.

56. A print apparatus according to claim 55, wherein the ink jet print head discharges ink from an ink outlet using thermal energy generated by an electrothermal converter.

57. A print apparatus according to claim 55, wherein the ink jet print head is a serial print head and the head mounting portion comprises a carriage for holding and conveying the serial ink jet print head.

58. A print apparatus according to claim 55, wherein the ink jet print head is a full line print head and the head mounting portion holds the full line ink jet print head.

* * * * *